US007811416B2

(12) United States Patent
Kallmes

(10) Patent No.: US 7,811,416 B2
(45) Date of Patent: Oct. 12, 2010

(54) APPARATUS AND PROCESS FOR DIGESTING CELLULOSIC MATERIAL

(76) Inventor: Andrew Kallmes, 10319 Westlake Dr., #164, Bethesda, MD (US) 20817

( * ) Notice: Subject to any disclaimer, the term of this patent is extended or adjusted under 35 U.S.C. 154(b) by 776 days.

(21) Appl. No.: 11/696,737

(22) Filed: Apr. 5, 2007

(65) Prior Publication Data

US 2008/0245496 A1 Oct. 9, 2008

(51) Int. Cl.
*D21C 7/10* (2006.01)

(52) U.S. Cl. ..... 162/250; 162/247; 162/249; 422/289; 422/290

(58) Field of Classification Search ..... 162/250, 162/247, 249, 233; 422/289, 290, 285, 307
See application file for complete search history.

(56) References Cited

U.S. PATENT DOCUMENTS 5,114,540 A * 5/1992 Law ..... 162/247

OTHER PUBLICATIONS

M/K Systems 750 Series Laboratory Digester Product sheet, Jun. 2008.*

* cited by examiner

*Primary Examiner*—Mark Halpern
(74) *Attorney, Agent, or Firm*—Louis L. Wu

(57) ABSTRACT

Provided is an apparatus for digesting cellulosic material that includes a vessel containing a digestion chamber and having an opening that provides access to the digestion chamber. A container for holding the cellulosic material is located within the digestion chamber. A closure interfaces with the vessel opening to form a seal against a predetermined digestion pressure and temperature within the chamber. A fluid-transporting system directs digestion fluids from a supply in the digestion chamber through a port and the container toward any cellulosic material therein. Digestion fluid distributed from the port through the container soaks the cellulosic material. Also provided are processes for digestion cellulosic material.

19 Claims, 7 Drawing Sheets

APPARATUS AND PROCESS FOR DIGESTING CELLULOSIC MATERIAL

BACKGROUND OF THE INVENTION

1. Field of the Invention

The invention relates generally to apparatuses and processes for digesting cellulosic material. In particular, the invention relates to cellulosic digestion apparatuses and processes that involve a means for distributing pressurize digestion fluid to increase cellulosic digestion efficiency, an improved sealing assembly, and/or an improved fluid flow transporting design that leads to systemic longevity.

2. Description of Background Art

Paper manufacturing typically requires digestion of a cellulosic material, e.g., wood chips. For example, a cellulosic digestion process may involve impregnating wood chips with fresh cooking liquor (white liquor) and then placing the impregnated chips in a digesting apparatus where they may be heated to cooking temperature. Once cooked down, the cellulosic material is digested and converted into pulp. To create white paper, the pulp is typically then washed, refined, further delignified, and bleached using any of a number of oxidizing agents, e.g., chlorine-based or other high strength oxidizers.

There is a substantial current need for improved pulping apparatuses adaptable to produce paper pulp and/or intermediate fibrous materials rapidly and in high yields. Such apparatuses may be used to produce pulp from a wide variety of cellulosic materials and may be designed to carry out cellulosic digestion in batch or continuous processes. In a conventional batch cooking sulfite process, for example, a digester is filled with wood chips and charged with fresh cooking liquor. The digester is then sealed, and heated to cooking temperature by direct or indirect heating. Once cooked, a substantial portion of the lignin and carbohydrates may be degraded and/or leached from the pulp. Spent cooking liquor (black liquor) and the pulp are separated after cooking.

The laboratory digester is one of the most widely used instruments in the pulp and paper industry. The digester allows a user to experiment with a wide range of chemical compositions in order to optimize the full-scale cooking process. Laboratory digesters are available in a wide range of volumes and may provide critical insight into the chip cooking process for scale-up and/or optimization efforts.

A number of laboratory digesters are commercially available. For example, M/K Systems, Inc. (Bethesda, Md.) manufactures a high-pressure batch process digester that runs pulp-digesting processes on a laboratory scale in a controlled precise manner. Available in both single and dual vessel models, the digester provides excellent control over the cooking profile as well as homogeneous temperature distribution due to excellent systemic flow control. In addition, the digester is suitable for both alkaline and acid digesting process with various types of wood chips and fiber sources. Furthermore, the digester is designed to operate at high temperatures at an elevated pressure, i.e., up to about 300 PSI.

Nevertheless, there exist opportunities to provide alternatives and improvements to cellulosic digestion technologies, particularly to overcome any shortcomings associated with known cellulose digesters. For example, improvements may be made in the areas of digestion efficiency and quality. In addition, improved sealing and fluid-transportation technologies may enhance the safety, convenience, and corrosion associated with the operation of high-pressure digesters.

SUMMARY OF THE INVENTION

In a first aspect, the invention provides an apparatus for digesting a cellulosic material, e.g., wood chips. The apparatus includes a vessel containing a digestion chamber and having an opening that provides access to the digestion chamber. Within the digestion chamber is a container for holding the cellulosic material. A closure is provided to interface with the vessel opening to form a seal against a predetermined digestion pressure and temperature within the chamber. Also provided is a fluid-transporting system adapted to direct digestion fluid from a supply in the digestion chamber through a port and the container toward any cellulosic material therein. Further provided is a means for distributing digestions fluid from the port through the container to soak the cellulosic material.

The digestion fluid may be distributed using any of a number of means. The digestion fluid may be distributed in a pressurized manner effective to enhance cellulosic digestion efficiency. For example, pressurized transport of digestion fluid may increase the rate of digestion fluid infusion into and transport within the cellulosic material. In addition, the means for distributing digestions fluid may be located downstream from the port and upstream from any cellulosic material in the container.

Typically, the means for distributing digestions fluid includes a fluid-conveying member having a plurality of perforation through which digestion fluid is distributed to any cellulosic material in the container. The perforations may be arranged in an array and be of substantially identical in shape and/or in size or be in a range of different sizes or shapes. For example, the fluid-conveying member may include a tube having a lumen extending lengthwise from an open proximal terminus attached to the port to a closed distal terminus. Perforations along the length of the tube may fluidly communicate with the lumen. Optionally, the means for distributing digestions fluid may be mounted to the closure and/or attached to the port.

Containers suitable for use with the invention may vary as well. For example, the container may vary in volume according to a change in digestive state of any cellulosic material contained therein. Typically, though, the container includes a basket for holding cellulosic material therein, and porous weight that is movable relative to the basket. When the porous weight is placed over cellulosic material in the basket, the container effectively varies in volume according to a change in digestive state of the cellulosic material in the basket. In some instances, a porous weight is interposed between any cellulosic material in the basket and the means for distributing digestions fluid.

The closure of the apparatus may interface with the vessel opening appropriate for certain operating parameters and/or process conditions. For example, the process conditions may involve basic or acidic digestion. In such a case, a supply of basic or acidic digestion fluid may be located within the chamber. The invention may be used to carry out batch or a continuous digestion process.

In addition, the closure may form a seal against the vessel opening to withstand a range of predetermined digestion pressures and temperatures within the chamber. Typically, the seal may be effective against pressures of no less than about 100 or about 300 pounds per square inch (PSI). In addition, the seal may be effective against such pressures at temperatures no less than about 100 or about 200° C. Such pressures and temperatures may be achieved using a heater adapted to heat the chamber.

To effect such sealing capabilities, the vessel of the invention in some embodiments may have an exterior vessel surface in which the opening is located and an interior vessel surface that terminates at the opening. The closure may comprise a closure flange and a piston, the closure flange has a surface facing the exterior vessel surface, and the piston has a surface that faces the interior vessel surface. A sealing assembly may further be provided comprising first and second sealing rings. The sealing assembly may be situated such that the first sealing ring is interposed between the facing flange and exterior vessel surfaces, and the second sealing ring is interposed between the facing piston and interior vessel surfaces.

In another aspect, the invention provides an apparatus similar to that described above but with improvement to the fluid-transporting system. In some instances, a means for relieving any excessive pressure buildup in the digestion chamber, e.g., a rupture disk, is positioned relative to the fluid-transporting system in a manner that promotes gravitational flow of digestion fluid away from the pressure relieving means. Optionally, a single egress may be provided for draining digestion fluid from the digestion chamber via gravitational flow.

In other embodiments, the invention provides processes for digesting a cellulosic material.

BRIEF DESCRIPTION OF THE DRAWINGS

FIG. 4A depicts in cross-sectional view a fluid-transporting member in the form of an elongate tube having perforations along its length. FIG. 4B is a photograph of a fluid-transporting member similar to that depicted in FIG. 4A which has been mounted to a closure having a plurality of holes through which fastening bolts may be inserted. FIG. 4C depicts in cross-sectional view a fluid-transporting member in the form of a nozzle having a generally conical shape and a two-dimensional array of perforations through the base of the nozzle.

DETAILED DESCRIPTION OF THE INVENTION

Definitions and Overview

Figure 1:
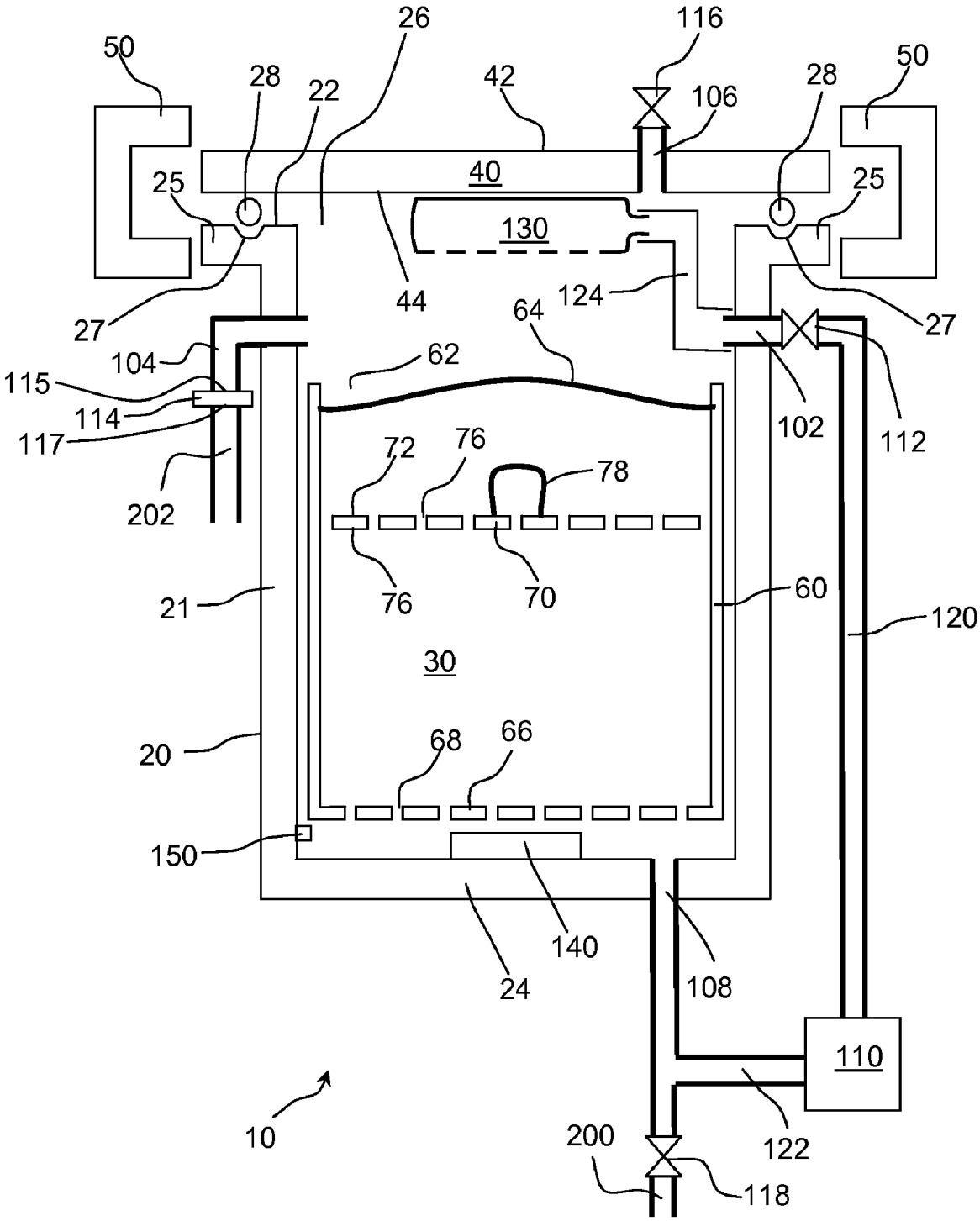
FIG. 1 depicts a single vessel embodiment of the inventive apparatus in cross-sectional view.

Before describing the present invention in detail, it is to be understood that the invention is not limited to specific digestion fluids or apparatus setups, as such may vary. It is also to be understood that the terminology used herein is for describing particular embodiments only, and is not intended to be limiting.

In addition, as used in this specification and the appended claims, the singular article forms "a," "an," and "the" include both singular and plural referents unless the context clearly dictates otherwise. Thus, for example, reference to "a chamber" includes a plurality of chambers as well as a single chamber, reference to "fluid" includes a fluid as well as a mixture of fluids, and the like.

Furthermore, terminology indicative or suggestive of a particular spatial relationship between elements of the invention is to be construed in a relative sense rather an absolute sense unless the context of usage clearly dictates to the contrary. For example, the terms "over" and "on" as used to describe the spatial orientation of a first item relative to a second item does not necessarily indicate that the first item is located necessarily above the second item. That is, the first item may be located above, at the same level as, or below the second item depending on the device's orientation. Similarly, an "upper" surface of an item may lie above, at the same level as, or below other portions of the item depending on the orientation of the item.

In this specification and in the claims that follow, reference will be made to a number of terms that shall be defined to have the following meanings, unless the context in which they are employed clearly indicates otherwise:

The term "array" is used herein in its ordinary sense and refers to an ordered arrangement of features in one, two, or three dimensions, e.g., rectilinear grids, parallel stripes, spirals, and the like.

The terms "cellulose, "cellulosic" and the like are used herein in their ordinary sense and refer to a complex carbohydrate or polysaccharide that includes a plurality of monomeric glucose units ($C_6H_{10}O_5$). As is well known in the art, cellulose constitutes the chief part of the cell walls of plants, occurs naturally in fibrous products such as cotton and linen, and is the raw material of many manufactured goods such as paper, rayon, and cellophane.

The term "chamber" is used herein to refer to a compartment or enclosed space. For example, a "digestion chamber" within a vessel refers a compartment or enclosed space within the vessel in which digestion may take place.

The term "closure" is used herein to refer to an item that closes. For example, a closure may take the form of a lid, plug, cap, or the like to close an opening of a vessel.

The terms "digest," "digestion," and the like are used herein in their ordinary sense in the field of chemistry and refer to softening, disintegration, and/or decomposition of a material such as cellulose) by means of heat, chemical action, and/or the likes. Thus, the term "digestion fluid" refers to a liquid and/or gaseous substance, that is capable of flowing, that changes its shape at a steady rate when acted upon by a force, and that aids in the softening, disintegration and/or decomposition of a material. Similarly, the term "liquor" as used herein refers to a solution used to carry out cellulosic digestion.

The term "flow path" as used herein refers to the route or course along which a fluid travels or moves.

The term "fluid-tight" is used herein to describe the spatial relationship between two solid surfaces in physical contact such that fluid is prevented from flowing into the interface between the surfaces.

The term "pressurized" as used herein refers to subjecting a fluid under a force per unit area greater than that which otherwise surrounds the fluid.

The term "substantially identical" as used to describe a plurality of items is used to indicate that the items are identical to a considerable degree, but that absolute identicalness is not required. For example, when perforations are described herein as of a "substantially identical size," the perforations' size may be identical or sufficiently near identical such that any differences in their size are trivial in nature and do not adversely affect the performance of the perforations' function. The terms "substantial" and "substantially" are used analogously in other contexts involve an analogous definition.

The term "vessel" is used herein in its ordinary sense and refers to a hollow or concave item, typically sealable, for holding fluids or other contents.

Digestion Apparatus

In general, the invention relates to an apparatus for digesting a cellulosic material. The apparatus includes a vessel containing a digestion chamber accessible through a vessel opening. A closure is also provided to interface with the vessel opening against a predetermined digestion pressure and temperature within the chamber. Located inside the digestion chamber is a container for holding a cellulosic material. A fluid-transporting system is adapted to direct digestion fluid through a port toward any cellulosic material in the container. Furthermore, a means may be provided for distributing the digestion fluid from the port in a manner effective to increase cellulosic digestion efficiency.

The materials used to form the components of the inventive apparatus are selected with regard to physical and chemical characteristics that are desirable for proper functioning of the apparatus. For example, all materials used to construct the various components of the inventive apparatus should be chemically inert and physically stable with respect to any substance with which they come into contact when used to carry out cellulosic digestion (e.g., with respect to pH, etc.).

An exemplary simplified single vessel apparatus of the invention is schematically depicted in FIG. 1. As with all figures referenced herein, in which like parts are referenced by like numerals, FIG. 1 is not necessarily to scale, and certain dimensions may be exaggerated for clarity of presentation. As shown in FIG. 1, the apparatus 10 includes a single cylindrical vessel 20 having a curved sidewall 21 bounded by a generally planar top surface 22 and a platen base 24. Sidewall 21 is generally perpendicular to each of the top surface 22 and the platen base 24. Optionally, a flange 25 extends outwardly from the top of vessel 20 perpendicular to sidewall 21, thereby defining in part the top surface 22 of the vessel 20. An opening 26 at the top surface 22 provides access to digestion chamber 30 within vessel 20. Typically, the opening 26 is sized and shaped allow facile transport of materials into and out of the chamber. Optionally, the size of the opening has a cross sectional area equal to or greater to the cross-sectional area of any other portion of the chamber 30 along an axis perpendicular to the opening. Optionally, markings (not shown) may be present on an interior surface of the sidewall 21 to as to provide a visual fill-line that indicates the level to which digestion fluid may be filled for optimal performance.

As shown in FIG. 1, a groove 27 is located on the top surface 22 of the vessel 20. While the groove 27 is shown as generally circular in shape, alternative embodiments of the invention may include grooves of any of a number of cross-sectional shapes. Seated within groove 27 is elastic ring 28 having a shape that generally conforms to the groove 27. Optionally, one or more additional concentric grooves and rings (not shown) may be provided on surface 22 as well. Further optionally, sealing gasket materials may be used in the place of elastic rings and/or grooves (also not shown).

Also provided is a closure 40 in the form of a lid having substantially parallel upper and lower planar surfaces indicated at 42 and 44, respectively. Lid 40 may be placed over opening 26 such that lower surface 44 faces top vessel surface 22 and that elastic ring 28 is interposed between surface 44 and 22. When the lid 40 is urged together with flange 25 applied using clamps 50, the ring 28 may be compressed between surface 22 and 44. As a result, a fluid-tight seal may be formed between the lid 40 and the vessel 20.

A container 60 may be placed within the digestion chamber 30 through opening 26 located in top planar surface 22 of the vessel 20. When sealed within the digestion chamber 30, the container 60 may serve to hold a cellulosic material therein for digestion by digestions fluids within the chamber. As shown, the container 60 formed from a cylindrical basket having an opening 62 at its top through which cellulosic materials may be loaded into the container 60. The container 60 has a shape and size generally similar to that of the chamber 30 to reduce dead space within the chamber 30 in which no cellulosic digestion may be digested. Optionally, a handle 64 may be attached to the opposing points on the sidewalls near the top of the container 60 to allow a user a convenient means for maneuvering the container 60 in and out of vessel 20.

The container 60 typically also has a bottom 66 containing one or more holes 68 through which digestion fluid may flow. As shown, the bottom may be formed from a wire mesh, but any perforated bottom may generally be used with the invention as long as the holes 68 are appropriately sized and located. For example, the one or more holes 68 are typically sized to ensure that cellulosic material within the container 60 remains within the container before, during, and after exposure to digestion fluid within the chamber 30. Often, the holes are arranged in an array. Optionally, the sidewalls of the container 60 may also contain holes of appropriate size and arrangement.

Figure 2:
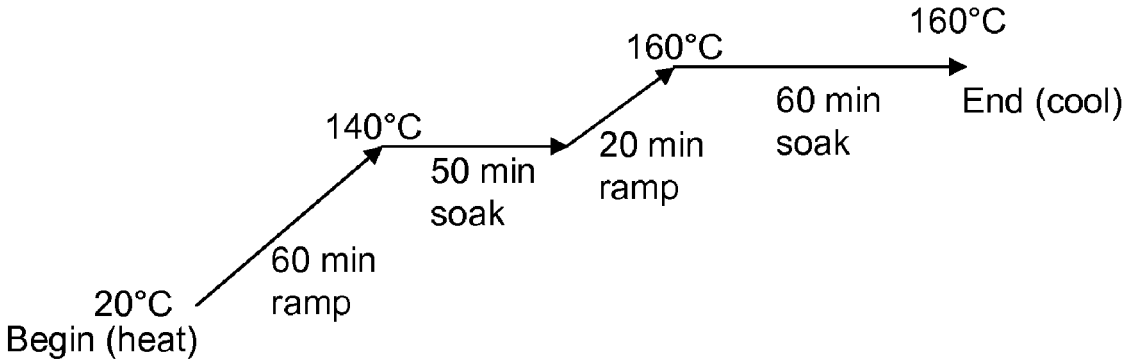
FIG. 2 is a photograph of a basket with a handle in combination with a dispersion weight suitable for use with the invention.
Figure 3:
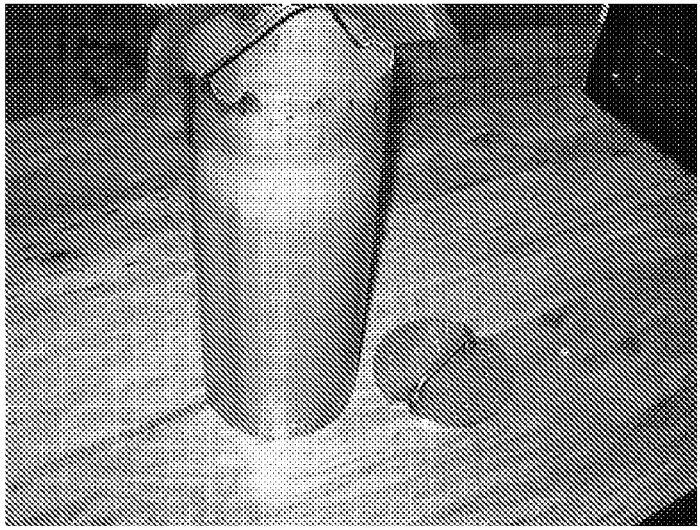
FIG. 3 provides a diagram that shows an exemplary heating profile that may be used to effect cellulosic digestion in a digester.

In some instances, the container may vary in volume according to a change in digestive state of any cellulosic material contained therein. For example, a perforated fluid-dispersion weight 70 in the form of a disk having generally opposing parallel upper and lower surfaces indicated at 72 and 74, respectively. The weight also contains an array of holes 76 extending through surfaces 72 and 74 that provides a plurality of flow paths through which fluids may travel. In other words, the weight 70 is effectively rendered porous for digestion fluid flow-through. The disk 70 is shaped and sized to allow it to be placed in movable relationship with container 60. Optionally, a handle 78 attached to upper surface 72 may be provided to allow for facile handling of the weight 70. An exemplary basket and dispersion weight suitable for use with the invention is shown in FIG. 2.

In operation, cellulosic material may be placed within the container 60, and the porous weight 70 may be placed over the cellulosic material with lower surface 74 facing the cellulosic material and the bottom 66 of basket 60. As a result, the effective volume of the basket 60 for containing cellulosic material is bounded by the basket 60 and the weight 70. As the digestive state of the cellulosic material in the basket changes, the spatial relationship between the basket and the weight may change as well. As a result, the container 60 may effectively vary in volume according to the cellulosic material in the basket. Typically, as cellulosic material is digested, the mechanical strength of the material is decreased. The weight 70 will tend to compress the cellulosic material as its physical integrity degrades, thereby reducing the effective volume of the basket.

The apparatus also includes a fluid-transporting system for transporting digestion fluid within the digestion chamber. The fluid-transporting system serves to direct digestion fluid through a port and the container toward any cellulosic material in the container. In some instances, the fluid-transporting system may be adapted to direct digestion fluid from a supply exterior to the digestion chamber toward the cellulosic material therein in the container. In addition or in the alternative, the fluid-transporting system may be adapted to direct digestion fluid from a supply within the chamber toward the cellulosic material.

As shown in FIG. 1, the fluid-transporting system may include a plurality of components that are interfaced with the digestion vessel 20 and/or chamber 30 via a plurality of ports (inlet, outlet or other types of ports) through the vessel 20 and the lid 40. For example, a liquor inlet port 102 and a first pressure interface port 104 are disposed through opposing sections near the top of sidewall 21. A second pressure interface port 106 is disposed through lid 40. A liquor outlet port 108 is located in the base 24 of the vessel 20. Additional vessel ports or "nipples may be present. Typically, a vessel may have three or four ports to facilitate access by interrogative instrumentation and other accessories.

As shown in FIG. 1, components that may be interfaced with the vessel 20 and/or the chamber 30 include a circulation pump 110, a flow control valve 112, a rupture disk 114, a pressure release valve 116, and a drain valve. The circulation pump 110 fluidly communicates with control valve 112 via conduit 120, and the flow control valve 112 is connected with liquor inlet port 102. A branching conduit 122 provides fluid communication between the liquor outlet port 108 and the circulation pump 110 and the drain valve 118. Drain valve 118 allows effluent from conduit 122 to flow out first drain egress 200.

Pressure interface ports may be used to provide an interface with components that act in response to pressures present in the chamber 30. For example, the pressure release valve 116 is connected with the second pressure interface port 106, which allows vapor communication between the pressure release valve 116 and the chamber 30. The pressure release valve allows for controlled venting of the chamber 30 to ensure control over pressure therein.

The rupture disk 114 is shown connected with the first pressure interface port 104, which allows vapor communication between the rupture disk 114 and the chamber 30. The rupture disk 114 has a first surface 115 in vapor communication with chamber 30 via interface port 104 and an opposing second surface 117 that faces a second drain egress 202. The disk 114 serves as a safety mechanism to ensure that any excessive pressure buildup in the chamber 30 does not lead to explosive or catastrophic failure of the apparatus 10. For example, a rupture disk may be provided that ruptures at a predetermined pressure limit that is slightly higher than a peak desired processing pressure. Thus, when the peak desired processing pressure is 300 pounds per square inch (PSI), rupture disks that vent at 310 PSI may be used. Effluent released from the rupture disk 114 can be expelled from the apparatus 10 via drain egress 202.

Furthermore, additional components within the chamber 30 may also be interfaced to the fluid-transporting system as well. For example, a digestion fluid distributing means 130 in the form of dispersion nozzle may be connected to liquor inlet port 102 via conduit 124. As shown, the nozzle 130 is mounted to lid 40, but such mounting is not required. The nozzle 130 is oriented such that emerging fluid is directed toward the basket 20 and the weighted disk 70 located therein.

As a result, a plurality of flow paths is created that passes through the chamber 30. A first flow path allows fluid drain from the bottom of the chamber 30, in order, through outlet port 108, conduit 122, and out of apparatus 10. A second flow path allows fluid from the chamber 30, in order, through outlet port 108, the circulation pump 110, conduit 120, control valve 112, inlet port 102, conduit 124, nozzle 130, opening 62 or basket 60, holes 76 of weight 70, and holes 68 in the bottom 66 of the basket 60, and back into the bottom of the chamber 30.

The apparatus 10 typically also includes a heater 140 and a temperature detector 150 as well. As shown, the heater 140 is located in the chamber 30 mounted to the base 24 of vessel 20. Optionally (not shown), a heater lead may be provided through a port extending through the vessel base 24. However, alternative heating mounting schemes may be used as well. For example, vertically mounted heaters are particularly useful in continuous process contexts. Similarly, the detector 150 is mounted in the chamber in the middle of the sidewall 21. Also optionally (not shown), a detector lead may be provided through a port extending through the vessel sidewall 21 with lead 152 extending through port 154. The placement of the heater 140 and the detector 150 may be selected to ensure their optimal performance, e.g., so as to provide uniform heating and rapid detection response. However, the heater and temperature detector may be located elsewhere as well. For example, the heater and temperature detector may generally be placed anywhere along the second flow path, as long as the heater and temperature detector do not interfere with each other's performance.

Any of a number of heaters and detectors may be used with the invention. For example, the heater include an electrically powered resistive heating element and/or use gaseous, liquid, or solid combustion technologies known in the art that carries out heat transfer through conduction, convection and/or radiation. Exemplary temperature detectors suitable for use with the invention include thermocouple, photodiode, and other technologies known in the art. An optional programmable controller (not shown) may be provided that uses signal from the detector to control output from the heater so as to ensure that the chamber's temperature and pressure conforms to a desired profile. Such controllers are widely available and may be obtained from numerous commercial vendors, e.g., Omega (City, State).

Digestion Process and Parameters

In operation, the digester 10 shown in FIG. 1 may be used to effect cellulosic digestion in the manner described below. While the inventive digestion process is generally described below as comprising a plurality of steps to be carried out in succession, one of ordinary skill in the art will recognize that at least some of these steps may be carried out in an overlapping or simultaneous manner. The order in which the steps are carried out may vary as well.

As an initial matter, the digester may be used to digest any cellulosic material. However, materials that are of substantial or high cellulosic content are generally preferred. Exemplary cellulosic materials include, wood chips, raw cotton, hemp, flax, bamboo, etc. However, the digester may be optimized for use with a particular material. For example, the holes 68 in the bottom 66 of basket 60 may be of a sufficiently large size to as to allow for uninhibited fluid through flow but of a sufficiently small size to ensure containment of cellulosic material loaded therein. Cellulosic material may be placed through opening 62 into basket 60, followed by porous weight 70. Care should be taken to ensure that the weight 70 is positioned in a manner that that allows for it to move and compress the cellulosic material as the bulk volume and mechanical strength of the material decreases through digestion. This may involve placing the weight 70 such that its lower surface 74 faces and is substantially parallel to the bottom 66 of basket 60. A user may then use the handle 64 to maneuver the basket 60, bottom 66 first, into the chamber 30 through chamber opening 26.

Digestion fluid may then be introduced into the chamber 30. Depending on the digestion chemistry desired by the user, any of a number of digestion fluids may be used. For example, the digestion fluid may be basic or acidic in nature and have a pH ranging from zero to 14. Similarly, the fluid may include oxidizing and/or reducing agents selected according to the cellulosic material in the basket 60. In any case, it is typically desirable to ensure that the drain valve 118 is closed before the digestion fluid is introduced into the chamber 30.

In some instances, the digestion fluid may be introduced into the chamber via opening 26. In such a case, the system power may be off. However, digestion fluid in some embodiments may be introduced into the chamber through the liquor inlet port 102 from a source (not shown) through pumping action effected optionally by pump 110.

The volume of digestion fluid added may vary according to the design of the inventive apparatus and other factors such as the volume and chemistry of the cellulosic material to be digested. Exemplary ratios of digestion fluid to cellulosic volumetric may range anywhere from 1:2 to 2:1 to 5:1 to 10:1. In addition, a sufficient amount of digestion fluid may be introduced into the chamber 30 so that at least a portion of the cellulosic material and the outlet port 108 are submerged. Optionally, the weight 70 may be submerged as well. However, it is generally desirable to avoid introducing an excessive volume of digestion fluid into the chamber 60 so as to interfere with the workings of rupture disk 114 and the pressure control valve 112. These components typically require space to be allocated for vapor compression. Accordingly, it may be undesirable to submerge the first and second interface ports, 104, 106, respectively.

Before the chamber 30 is sealed, it may be desirable to operate the pump 110 in a purely circulatory manner without either the nozzle 130 or the conduit 124 connected to liquor inlet. Typically, fluid from the chamber 30 may be directed to displace any gas within conduits in the second fluid flow path using the pump 110 at a low speed so as to distribute digestion fluid systemically throughout the apparatus. As a result, overall fluid level in the chamber 30 may be lowered and trapped gas bubbles within the flow path, e.g., in the outlet port 108, the circulation pump 110, conduit 120, control valve 112, or inlet port 102 that contribute to irregular fluid flow may be displaced. In short, such pumping action effectively primes and/or warms up the apparatus for smooth cellulosic digestion in a controlled operation.

Once the apparatus has been primed and/or warmed up, conduit 124 may be attached to nozzle 130 and the inlet port 102, and the chamber 30 may be sealed in a fluid-tight manner against a predetermined digestion pressure and temperature within the chamber. Depending on the conditions required to carry out a desired cellulosic digestion operation, the predetermined pressure and temperature may vary. Typically, cellulosic digestion requires both heat and elevated pressure. Exemplary pressures suitable for effecting industrial cellulosic digestion are typically on the order of 50 to about 500 PSI, though higher pressures are often preferred over lower pressures. Thus, the predetermined pressure may be no less than about 100 to about 180 to about 300 PSI. Exemplary temperatures suitable for digest cellulosic materials in practice are typically about 50 to about 300° C. Thus, the predetermined temperature may be no less than about 100 to about 200° C.

For the apparatus 10 shown in FIG. 1, lid 40 may then be placed over the vessel opening 26 so as to form the fluid-tight seal against the predetermined digestion pressure and temperature within the chamber. Lid 40 may be placed over opening 26 such that lower surface 44 faces top vessel surface 22 and that elastic ring 28 is interposed between surface 44 and 22. Optionally, vacuum grease or some other sealing compound may be applied to the elastic ring 28 and/or portions of surfaces 44 and 22, which may come into contact with the elastic ring. Clamps 50 are then secured to the lid 40 and flange 25 to compress ring 28 so as to form a fluid-tight seal.

Other means may be used to provide a fluid-tight seal as well. Typically, a fluid-tight seal involves the immobilization of the lid 40 to the vessel flange 25. When corresponding holes are present in the lid and vessel flange (not shown), bolts may be extended through the corresponding holes to urge the lid and flange together. In some instances, alternative or additional external means may be used to urge the pieces together (such as clips, tension springs or associated fastening apparatus). Other means such as male and female couplings or friction fittings may be advantageously used as well. Releasable adhesives such as those in the form of a curable mass, e.g., as a liquid or a gel, may be placed between the substrates and subjected to curing conditions to form an adhesive polymer layer therebetween. Additional releasable adhesives, e.g., pressure-sensitive adhesives or solvent-containing adhesive solutions may be used as well.

Once the chamber 30 is sealed, the heater 140 and pump 110 may be used to cook the cellulosic material in the basket 60 in a controlled pressurized environment. Optionally, steam may be optionally introduced into the digester before cooking. The heater 140 may be used to heat any digestion fluid in contact therewith and may be controlled using feedback from the temperature detector. Depending on the desires of the user, the heater 140 may be controlled on the fly or follow a preprogrammed cooking profile. As shown in FIG. 2 for example, a preprogrammed heating profile may allow a heater 140 to ramp up and maintain various chamber temperatures over selected times. Since the volume in the chamber 30 remains constant while the temperature therein increases, pressure in the chamber 30 increases as well. Optionally, steam or another gas may be introduced into or extracted from the chamber 30, e.g., via control valve 112, while the chamber 30 is sealed so as to ensure that the pressure in the chamber 30 is maintained within in an optimal range for cellulosic digestion without compromising safety.

Simultaneously, the pump may direct digestion fluid to baste the cellulosic material in the basket while the material is cooked. Because the bottom of the chamber is filled digestion fluid, that fluid represents a supply, which may be used to baste the cellulosic material in the basket. In operation, the pump 110 draws fluid from the supply at the bottom of the chamber through outlet port 108 into the pump 110. Then, fluid is forced through the conduit 120, control valve 112, inlet port 102, conduit 124, toward the nozzle 130. As discussed below, fluid emerging from the nozzle 130 is distributed toward the cellulosic material through the holes 76 of weight 70. Instead of merely flowing toward the cellulosic material under gravitational and surface forces, the nozzle 130 effectively concentrates fluid flowing therefrom into focused streams that increases the rate at which digestion fluid penetrates the cellulosic material. As a result, use of the nozzle 130 effectively increases cellulosic digestion efficiency over the digestion efficiency that would be achieved without the nozzle.

As a result of exposure to elevated temperature, elevated pressure, and continuous exposure to circulated (refreshed)

digestion fluid, the cellulosic material in the basket 60 may be digested to a desired degree. As the cellulosic material is digested, its physical integrity will become increasingly compromised. As a result, the weight 70 will typically move toward the bottom 66 of the basket 60 and compress the cellulosic material therebetween. Once the desired degree of digestion is achieved, the heater and/or pump may be turned off and the apparatus may be allowed to cool. Once cooling has taken place, the apparatus may be drained and cleaned.

Distribution of Digestion Fluid

Among other inventive facets described herein, it should be noted the manner in which digestion fluid is distributed and the means for distributing digestions fluid in particular represent novel and nonobvious aspects of the invention for a number of reasons. As an initial matter, the digestion fluid distribution means described herein has been observed to increase the velocity and dispersion of white liquor and/and other fluids from so as to increase penetration of such fluids into cellulosic fibers. In addition, it has been experimentally verified that such pressurized means, when employed with known digestion apparatuses in the art, increase cellulosic digestion efficiency of such apparatuses when compared with the digestion efficiency of such apparatuses without such pressurized means. In addition, such pressurized means are not limited to use with known digestion apparatuses and may be used with other apparatuses for cellulosic processing.

When used with digestion apparatuses such as that depicted in FIG. 1, the means 130 for distributing the digestion fluid is typically located downstream from the inlet port 102 and upstream from any cellulosic material in the container 60. As shown, in FIG. 1, the digestion-fluid distribution means 130 may be mounted to the lower lid surface. Such mounting allows fluid emerging from the means 60 to be accelerated toward the cellulosic material in the basket 60 under the force of gravity as well as forces generated by the pump 110. Optionally, the components of the apparatus 10 are arranged such that the porous weight 70 is interposed between any cellulosic material in the basket 60 and the means 130 for distributing the digestion fluid.

In addition, such means may include or consist of a fluid-conveying member having a plurality of perforation through which digestion fluid emerges is under pressure. Typically, the perforations are arranged in an array and are of substantially identical shape and/or size so as to ensure uniform distribution of digestion fluid. When fluid-conveying member is positioned to direct digestion fluid through its perforations through a fluid-dispersion weight containing a plurality of holes toward cellulosic material in a basket, the perforations of the fluid-convey member may have an arrangement, size, and/or shape selected according to the arrangement, size, and/or shape of the weight's holes so as to increase penetrative exposure of cellulose to the digestion fluid.

Figure 4A:
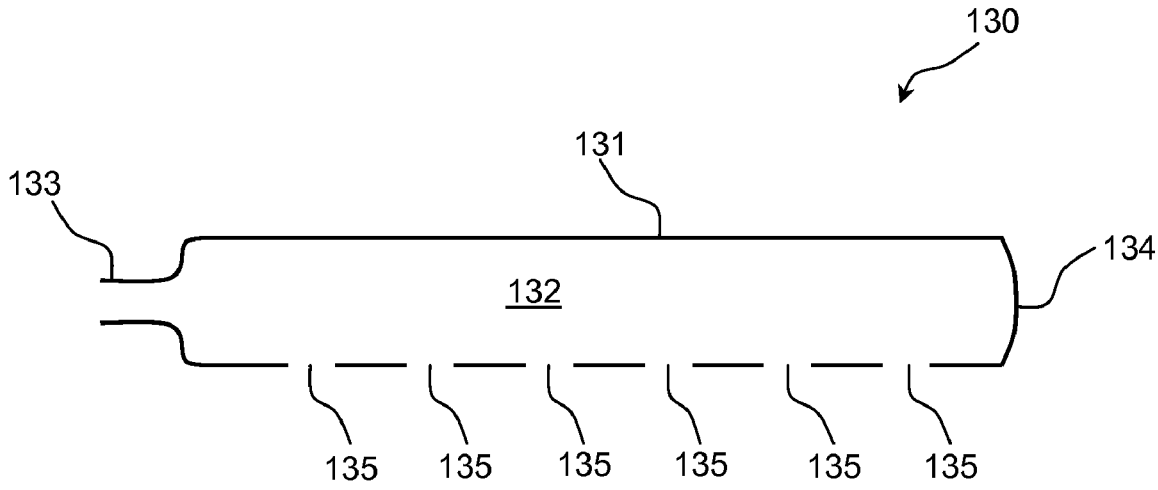
FIGS. 4A-4C, collectively referred to as FIG. 4, depict various embodiments of digestion-fluid distribution means.

FIG. 4A depicts an exemplary fluid-conveying member suitable for use with the invention. As shown, the fluid-conveying member is a dispersion nozzle 130 formed from a straight elongate tube 131 having a lumen 132 extending from an open proximal inlet terminus 133 to a closed distal terminus 134. A plurality of circular perforations 135 of arranged in a single equidistant linear array along the length of the tube. The perforations 135 extend through the wall of the tube 131. The proximal terminus 133 constructed to be attachable directly to a port or indirectly via a conduit to the port.

In operation, digestion fluid is directed through the open proximal inlet terminus 133 at a flow rate and pressure effective to allow the digestion fluid to occupy the entire lumen 132 or substantially the entire lumen 132. Consequently, pressurized digestion fluid is sprayed out of the perforations 135 at a velocity higher than that would be achieved from gravitation forces alone. Cellulosic material so sprayed in a digestion chamber typically exhibits a higher degree of digestion than cellulosic material exposed to digestion fluid under the same conditions but under gravitational forces alone.

Figure 4B:
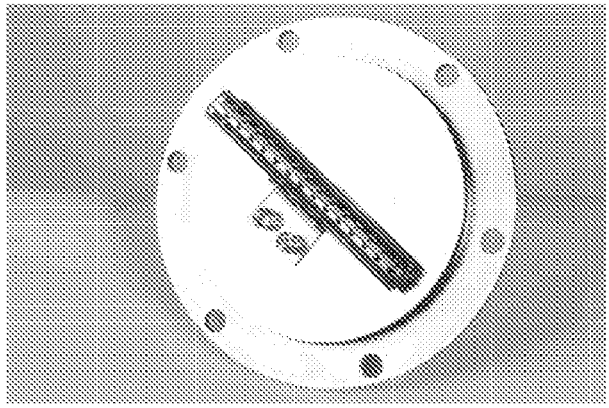

Other nozzle designs are possible as well. FIG. 4B is a photograph of a fluid-transporting member similar to that depicted in FIG. 4A, except that a plurality of arrays of circular perforations are arranged along the length of the tube. As shown, the tube is mounted via an L-shaped bracket to a lower surface of a lid having holes through which bolts may be extended allow the lid to seal a vessel (not shown).

Figure 4C:
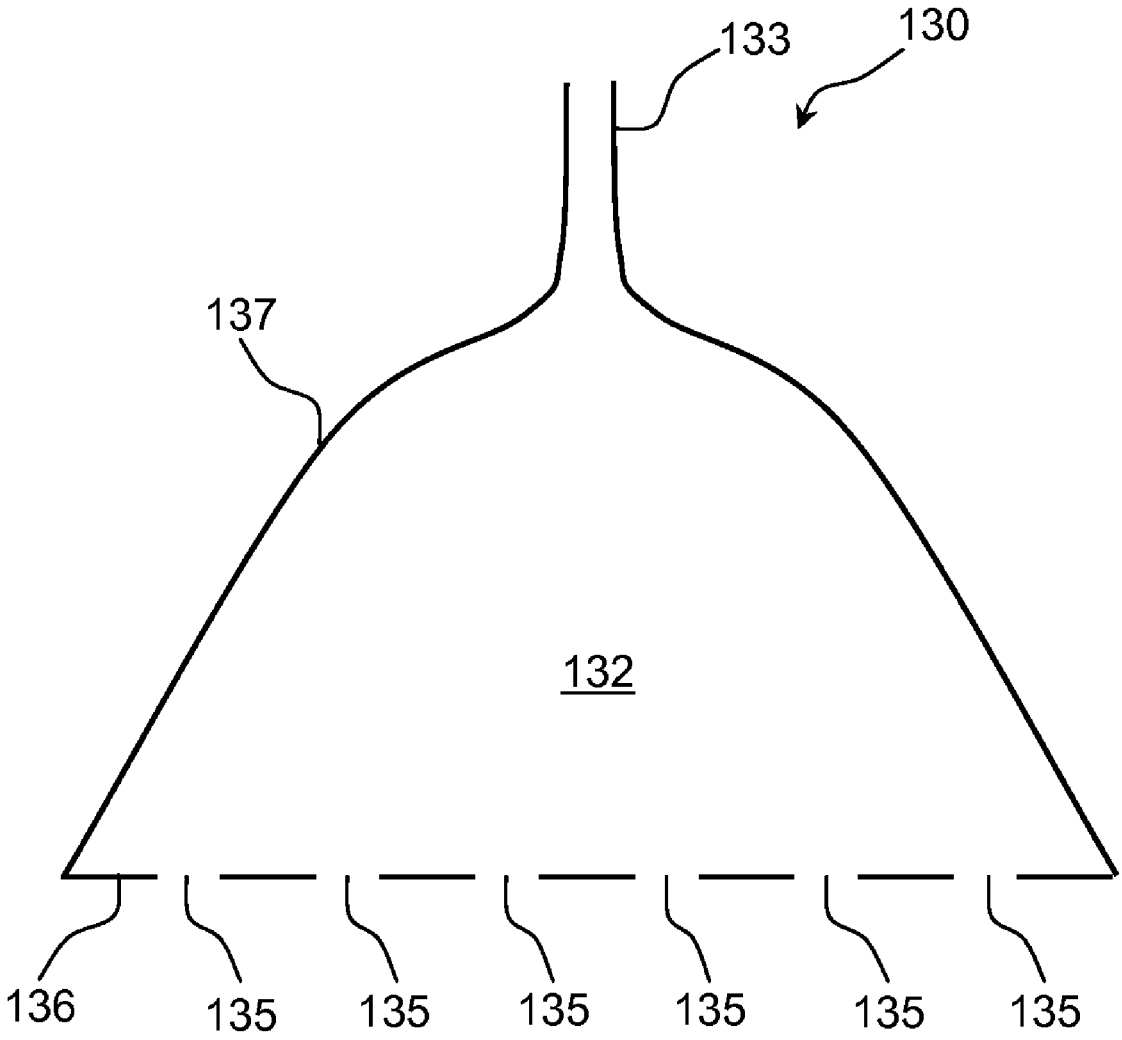

FIG. 4C depicts in cross sectional view another dispersion nozzle design in cross-sectional view. The nozzle 130 is generally conical in shape with an inlet 133 at its tip. A two-dimensional array of perforations 135 extends through the base 136 of the nozzle 130. Like the nozzle shown in FIG. 4A, digestion fluid, in operation is directed through the inlet 133 at a flow rate and pressure effective to allow the digestion fluid to occupy the interior 132 of the cone 137 in its entirety or in substantially its entirety, thereby allowing pressurized digestion fluid is sprayed out of the perforations 135 at a velocity higher than that would be achieved from gravitation forces alone.

Sealing and Safety Considerations

As discussed above, the inventive apparatus are typically run at an elevated temperature and/or pressure. As a result, certain embodiments of the invention provide advances in sealing and/or safety technologies. Sealing technologies other than those shown in FIG. 1 and described in accompanying text may be used. Such technologies, for example, may require modifications to the vessel and/or closure.

Figure 5:
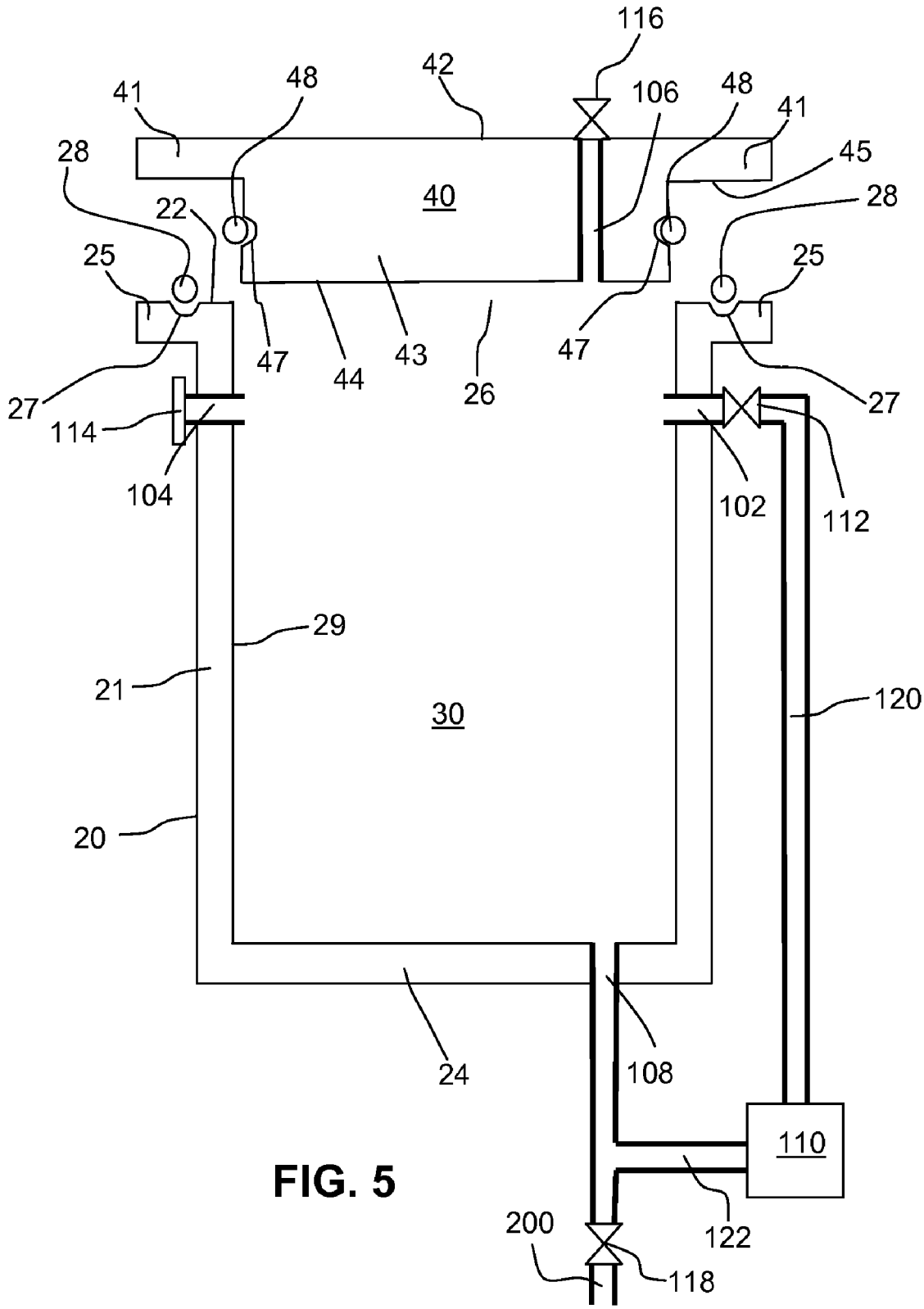
FIG. 5 depicts a digestion vessel and closure for sealing the vessel in cross-sectional view.

In some embodiments, e.g., as shown in FIG. 5, an alternative sealing technology may be employed. FIG. 5 shows a digestion vessel 20 and closure 40 for sealing the vessel 20 that are similar to but different from the vessel and closure shown in FIG. 1. In FIG. 5, a single cylindrical vessel 20 is provided having an overall shape similar to that shown in FIG. 1. Like the vessel shown in FIG. 1, the vessel shown in FIG. 5 also a curved sidewall 21 bounded by a generally planar upper surface 22 and a platen base 24. An opening 26 at the top surface 22 provides access to digestion chamber 30 within vessel 20. As a result, chamber 30 is effectively defined in a substantial portion by an interior vessel surface 29 that terminates at the opening 26. Notably, in FIG. 5, a vessel groove 26 is located on surface 22, within which elastic ring 28 is seated.

The closure 40 in FIG. 5 is generally comprised of a plurality of components, e.g., flange 41 and piston 43, that together form an integrated whole. Like the closure shown in FIG. 1, the closure 40 in FIG. 5 also has substantially parallel upper and lower planar surfaces indicated at 42 and 44, respectively. However, since flange 41 and piston 43 have different cross-sectional areas, upper surface 42 of the flange 41 is larger than lower surface 44 of closure flange closure piston 43. Lower flange surface 45, which is substantially planar and parallel to surface 42 and 22, effectively circumscribes piston 43, which is defined in part by cylindrical piston sidewall surface 46. A closure groove 47 is located on sidewall surface 46 within which elastic ring 48 is seated. Piston sidewall surface 46 is generally perpendicular to each of surface 42, 44, 45, and 46.

In operation, closure 40 may be placed such that piston 43 is inserted through opening 26 such that lower flange surface 45 faces upper vessel surface 22 and that piston sidewall surface 46 faces the interior vessel surface 29. As a result, ring 28 may be compressed between surfaces 22 and 45, and ring 48 may be compressed between surfaces 29 and 46. As a result, a fluid-tight seal may be formed between the lid 40 and the vessel 20.

The sealing technology shown in FIG. 5 provides a number of advantages over the sealing technologies known in the art in terms of safety and other operational considerations. As an initial matter, the sealing technology shown in FIG. 5 employs a plurality of elastic rings instead a single ring as shown in FIG. 1. Such redundancy lowers the risk of seal failure. In addition, the elastic rings in FIG. 5 are located between gaps of perpendicularly disposed surfaces. Such geometry provides additional protection against seal failure.

Additional safety features may be incorporated as well. For example, as discussed above, venting means such as rupture disks may be used to ensure that danger pressure levels cannot be achieved. In addition, audio and/or visual alarms may be provided. For example, a temperature alarm may be provided that sounds when either the heater reaches an excessive temperature, e.g., 500° C., or when the vessel temperature reaches 200° C. When these temperature limits are reached or exceeded, the power may be cut to the heater.

Optionally, rapid cooling technologies may be employed. For example, a cooling jacket may be placed around the heater. When water is fed through inputs of the cooling jacket and the heater is turned off, the jacket effectively converts heater into a component of a cooler. It has been demonstrated that a vessel may be cooled from 180° C. to less than 100° C. in about 15 minutes using such technologies.

Safety measures may be taken with the setup of the invention. For example, apparatus may be placed in a protected area, such as inside a dedicated room with sufficient clearance so as to allow any controller console to be placed away from the digestion vessel. Drain vents may also be installed near the apparatus. Optionally, the apparatus may be run behind an enclosure, perhaps a cement enclosure. In addition, the apparatus may be placed underneath a vent hood to draw away toxic chemicals that may be produced during the operation of the apparatus.

Inspection and maintenance the apparatus represents another important aspect of safety. For example, due to the pressures involved and the repeated cycling of the digester, various components of the digester may undergo fatigue. As a result, components of the digester and their interfaces may be inspected periodically for deterioration and replaced if necessary. Maintenance may be carried out periodically on components such as pumps and heaters.

Safety measures may be taken during the operation of the apparatus and the practice of the invention. In general, it is typically good practice to wear goggles and protective clothing when handling the digester. In addition, an operator should take care to make sure that the level of liquid in the digester conform to a desired range for proper operation of the fluid-transporting system since many pumps are not run designed to dry.

Once the apparatus is running, heat and pressure are generated. As a result, operators should typically avoid touching any uninsulated component of the digester that may be heated. For example, an operator may risk burns by touching digester conduits when the digester is running or has been recently been turned off without passage of sufficient cooling time. Typically the system requires 1.5 hours to cool. Similarly, while the digester is under pressure, operators should avoid forcing open the digester closure or removing a rupture disk. After it has been run, the digester should be vented and at ambient pressure before an operator may attempt to open the vessel. Such venting should be carried out while directing the venting line away from any operator or bystander.

Systemic Longevity and Convenience

As discussed above, the inventive apparatus are typically designed for use with digestion fluid. As digestion fluid tends to be quite corrosive, certain embodiments of the invention advance technologies that address problems associated with the corrosive-fluid handling and component corrosion. Alternatives to plumbing schemes and fluid-transporting systems shown in FIGS. 1, 5 and 6 may be used.

Figure 7:
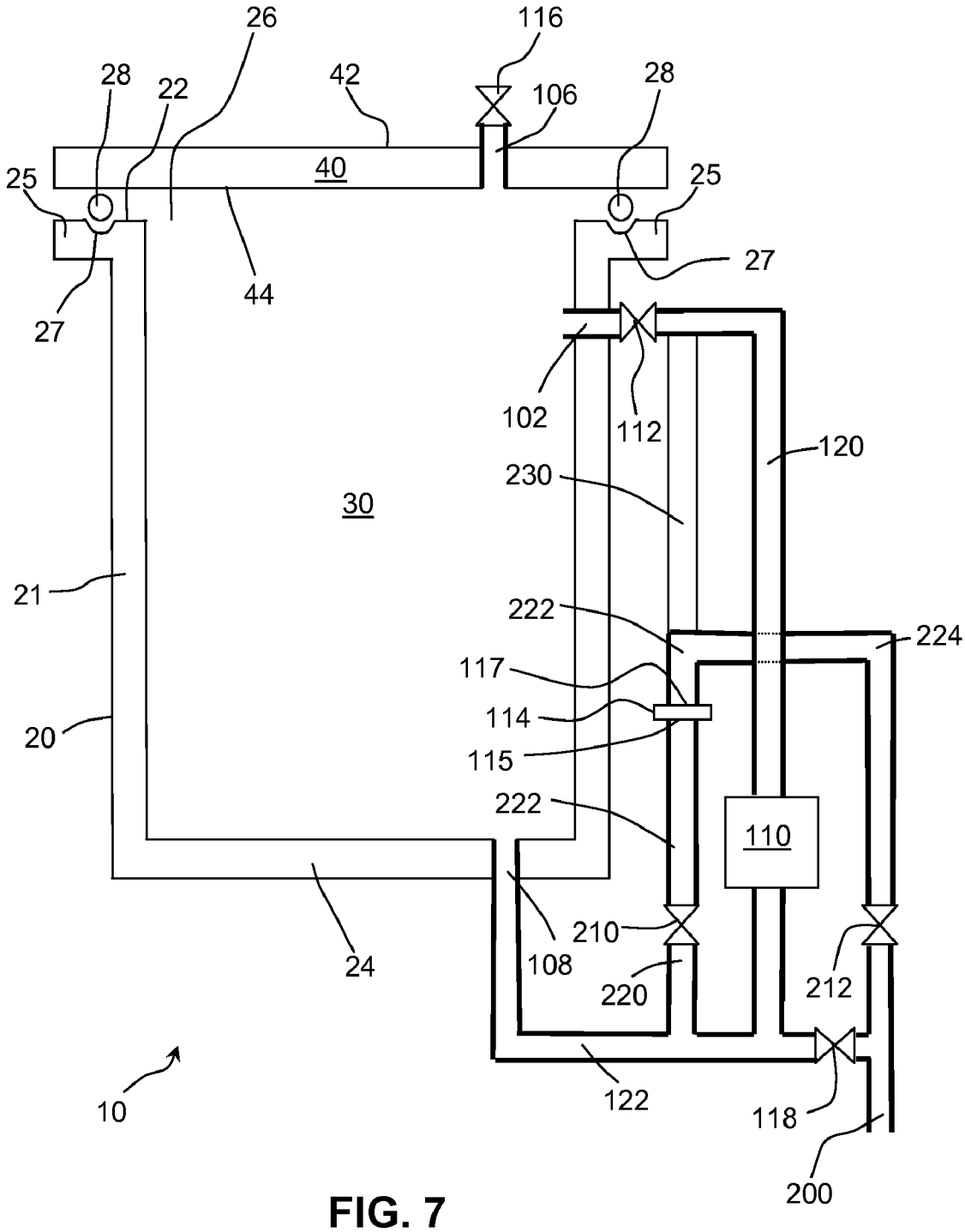
FIG. 7 depicts an embodiment of the invention having a fluid-transporting system having a single drain egress and a rupture disk positioned to facilitate gravitational flow of digestion fluid away from therefrom.

For example, FIG. 7 shows a digestion apparatus 10 similar to that shown in FIG. 1 but with a different fluid-transporting system and flow path arrangement. In FIG. 7, a single cylindrical vessel 20 is provided having an overall shape similar to that shown in FIG. 1. However, branching conduit 122 has been modified to provide an additional flow path. In addition, rupture disk 114 is not interfaced via a port extending directly from vessel 20. Instead, rupture disk 114 lies in the additional flow path that extends from branching conduit 122 to one-way check valve 210 to rupture disk 114 to conduit 222 to one-way check valve 212 to drain egress 200. Check valve 210 may be selected such that certain pressure thresholds must be met in order for fluid to flow from conduit 122 to conduit 220 though fluid may optionally flow from conduit 220 to conduit 122 via unchallenged gravitation forces. Similarly, check valve may be selected to allow for fluid flow from conduit 222 to egress 200 but not to allow for fluid flow in the reverse direction. In any case, solid attachment member 230 is shown engaging both conduits 222 and 120 so as to provide mechanical stability to the fluid-transporting system. Optionally, member 230 is a solid bar sized to interface with conduits 220 and 120 via ordinary tee fittings that having three openings that allow branch lines to be joined at a 90-degree angle.

The fluid-transporting system of FIG. 7 provides a number of advantages over the fluid-transporting system of FIG. 1. As an initial matter, the system of FIG. 7 includes a single drain egress while the system of FIG. 1 has a plurality of drain egresses. Because each egress represents a passage through which digestion fluid may flow under the force of gravity, a single drain construction provides a user-friendly means that reduces the potential for accidental exposure to digestion fluid.

In addition, the placement and orientation of the rupture disk in FIG. 7 provides an additional advantage over that of the rupture disk in FIG. 1 from a longevity perspective. In general, it has been found many commercially available means for relieving any excessive pressure buildup such as rupture disks may be more susceptible to corrosion. In addition, any digestion fluid entering port 104 of the apparatus shown in FIG. 1, e.g., through splatter, tends collect on surface 115 of rupture disk 114 because port 104 may not fluidly communicate with egress 202 unless rupture disk 114 has burst. As a result, it is difficult to remove digestion fluid collected on surface 115 unless rupture disk 114 is detached from port 104. In turn, unremoved fluid tends to corrode the rupture disk.

In contrast, the rupture disk 114 shown in FIG. 7 is generally isolated from any digestion fluid, unless pressure has built up to a degree that check valve 210 allows fluid from conduit 122 to pass through to conduit 220. If the rupture disk 114 does not burst, digestion fluid may be drained away from the disk via gravitational forces optionally through valve 210, conduit 122, valve 118, and egress 200. In other words, the rupture disk is less prone to corrode if positioned relative to the fluid-transporting system in a manner that promotes gravitational flow of digestion fluid away from the disk so as to reduce prolonged contact between the digestion fluid and the disk. Otherwise, digestion fluid passing through the rupture disk 114 may be transported through conduit 222, check valve 212 and egress 200.

Variations on the Invention

Variations of the present invention will be apparent to those of ordinary skill in the art in view of the disclosure contained herein. For example, the inventive apparatus may be designed to run on a number of different power sources. Direct current power sources, e.g., battery powered and/or alternating current power sources, e.g., 110V, 230V, 380V, single phase, may be used to power various components of the inventive digester.

In addition, the inventive apparatus may be constructed to carryout functions such as liquor extraction, metering, and/or measurement. Liquor extraction allows for the sampling of vapor or high temperature liquor during the cooking cycle. An external condenser may be used to collect condensate. Metering is typically carried out using pump with backpressure valves and allows a user to transfer precise quantities of liquor in at desired rates. Flow meters may allow a user to measure volumetric flow rates in the system.

Figure 6:
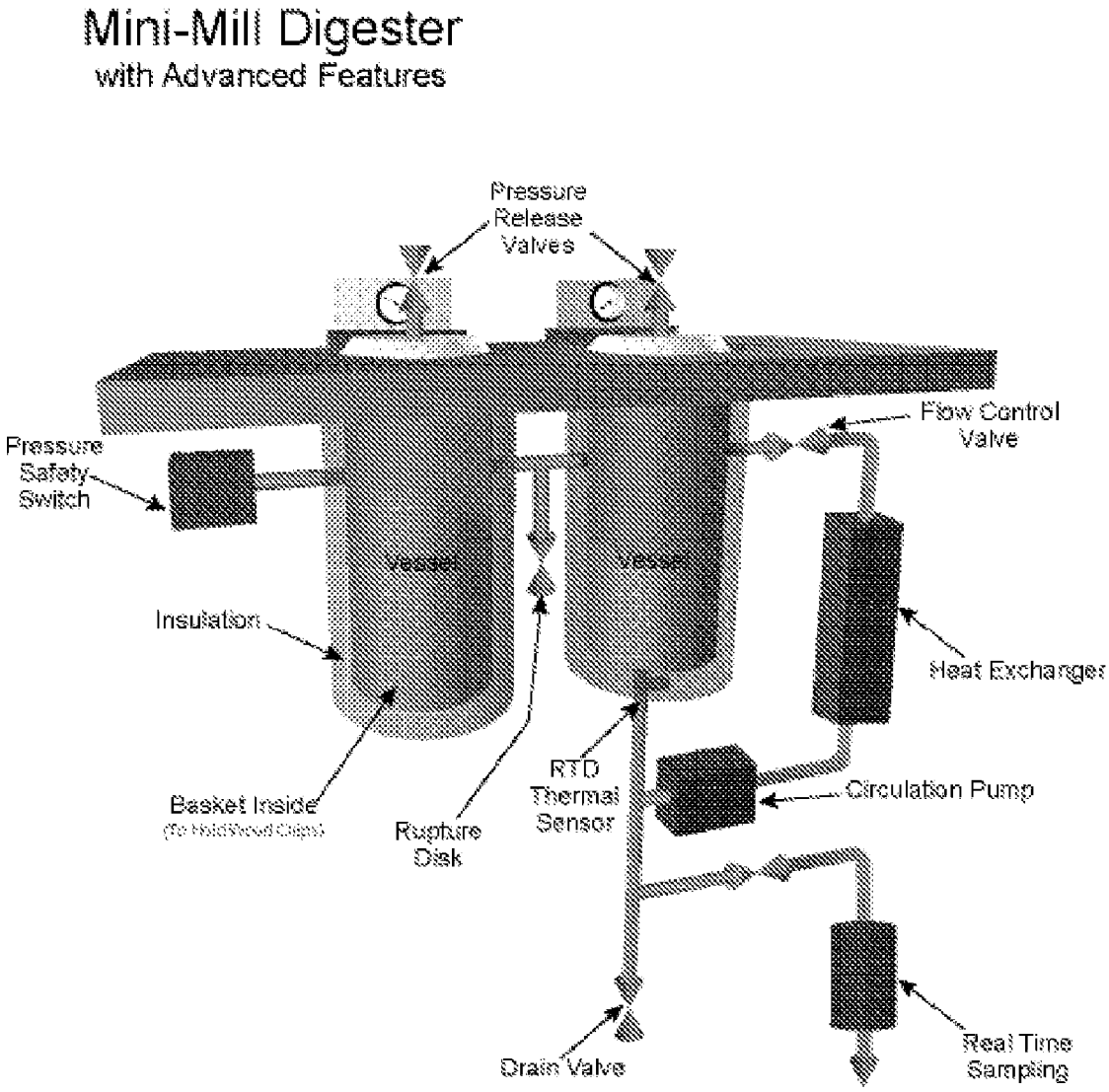
FIG. 6 schematically depicts a double vessel embodiment of the inventive apparatus and flow paths associated therewith.

The invention may be used in the context of digesters having a plurality of digestion vessels and chambers. For example, FIG. 6 schematically depicts a double vessel embodiment of the inventive apparatus and flow paths associated therewith. For such and other embodiments with two more chambers, a liquor transfer option may be provided to allow a user a convenient means to transfer liquids and vapor from a higher-pressure vessel to a lower pressure vessel. Typically, such transfer takes place when system and/or pump power are off. Valves between flow paths connecting the vessels are opened, and fluid transfer continues until the system is at steady state interrupted.

Furthermore, the invention may be used to carry out chemical reactions other than digestion and/or may serve as a part of a process that uses digested cellulosic material. For example, the invention may be used to carry out chemistries associated with the conversion of carbohydrates, polysaccharides, and cellulosic materials into alcohols. For example, the fluid-transporting system of the invention may be adapted to circulate yeast or other solutions that may be required to produce alcohol, optionally through fermentation. Similarly, when it is desirable to prevent oxidation of alcohols in the inventive apparatus, inert gas and/or vacuum technologies may be used to ensure that any chambers containing alcohol are free from the presence of oxygen or other oxidizing agents.

Additional variations of the invention may be discovered upon routine experimentation without departing from the spirit of the present invention.

It is to be understood that, while the invention has been described in conjunction with the preferred specific embodiments thereof, the foregoing description merely illustrates and does not limit the scope of the invention. For example, while the foregoing description focuses on the invention in a batch-processing context, the invention may also be of use in a continuous processing context. By incorporation fluid extraction and/or injection technologies, the inventive apparatus may be adapted to simulate continuous processes as well.

In any case, numerous alternatives and equivalents exist which do not depart from the invention set forth above. For example, the inventive apparatus may be constructed to contain or exclude specific features and components according to the intended use of the apparatus, and any particular embodiment of the invention, e.g., those depicted in any drawing herein, may be modified to include or exclude element of other embodiments. Alternatively, stated, different features of the invention described above may be combined in different ways. Other aspects, advantages, and modifications within the scope of the invention will be apparent to those skilled in the art to which the invention pertains.

I claim:

1. An apparatus for digesting a cellulosic material, comprising:

a vessel containing a digestion chamber and having an opening that provides access to the digestion chamber;

a closure adapted to interface with the vessel opening to form a fluid-tight seal against a predetermined digestion pressure and temperature within the chamber;

a container within the digestion chamber for holding a cellulosic material;

a fluid-transporting system adapted to direct digestion fluid from a supply in the digestion chamber through a port and the container toward any cellulosic material in the container; and a fluid-conveying member having a plurality of perforations for conveying digestion fluid from the port through the perforations for distribution towards cellulosic material in the container in a pressurized manner effective to increase digestion efficiency of any cellulosic material in the container as compared with digestion efficiency without the fluid-conveying member.

2. The apparatus of claim 1, wherein the container comprises a basket for holding cellulosic material therein, and a porous weight that is movable relative to the basket and placed over any cellulosic material in the basket to allow the container to vary in volume according to a change in digestive state of the cellulosic material in the basket.

3. The apparatus of claim 2, wherein the porous weight is interposed between any cellulosic material in the basket and the fluid-conveying member.

4. The apparatus of claim 1, wherein the perforations are arranged in an array.

5. The apparatus of claim 1, wherein the perforations are of substantially identical shape and/or size.

6. The apparatus of claim 1, wherein the fluid-conveying member comprises a tube having a lumen extending from an open proximal terminus attached to the port to a closed distal terminus and the perforations fluidly communicates with the lumen.

7. The apparatus of claim 1, wherein the fluid-conveyning member is mounted to the closure.

8. The apparatus of claim 1, wherein the fluid-conveying member is attached to the port.

9. The apparatus of claim 8, wherein the predetermined pressure is no less than about 180 PSI.

10. The apparatus of claim 1, wherein the predetermined pressure is no less than 100 PSI.

11. The apparatus of claim 1, wherein the predetermined temperature is no less than 100° C.

12. The apparatus of claim 11, wherein the predetermined temperature is no less than about 200° C.

13. The apparatus of claim 1, further comprising a supply of basic digestion fluid within the chamber.

14. The apparatus of claim 1, further comprising a supply of acidic digestion fluid within the chamber.

15. The apparatus of claim 1, adapted to in a manner effective to carry out a batch digestion process.

16. The apparatus of claim 15, further comprising a heater adapted to heat the chamber to the predetermined temperature, wherein the predetermined temperature is selected according to operating parameters for a digester adapted to carry out a continuous digestion process.

17. An apparatus for digesting a cellulosic material, comprising:

a vessel containing a digestion chamber and having an opening that provides access to the digestion chamber, wherein the vessel has an exterior vessel surface in which the opening is located and an interior vessel surface that terminates at the opening;

a closure adapted to interface with vessel to form a fluid-tight seal against a predetermined digestion pressure and temperature within the chamber, wherein the closure comprises a closure flange and a piston, the closure flange has a surface facing the exterior vessel surface, and the piston has a surface that faces the interior vessel surface;

a container within the digestion chamber for holding a cellulosic material;

a first sealing ring between the facing flange and exterior vessel surfaces; and a second sealing ring between the facing piston and interior vessel surfaces.

18. An apparatus for digesting a cellulosic material, comprising:

a vessel containing a digestion chamber and having an opening that provides access to the digestion chamber;

a closure adapted to interface with the vessel opening to form a fluid-tight seal against a predetermined digestion pressure and temperature within the chamber;

a container within the digestion chamber for holding a cellulosic material;

a fluid-transporting system adapted to direct digestion fluid from a supply in the digestion chamber through a port toward any cellulosic material in the container; and a rupture disk for relieving any excessive pressure buildup in the digestion chamber, wherein the rupture disk is positioned relative to the fluid-transporting system in a manner that promotes gravitational flow of digestion fluid away from the rupture disk.

19. An apparatus for digesting a cellulosic material, comprising:

a vessel containing a digestion chamber and having an opening that provides access to the digestion chamber;

a closure adapted to interface with the vessel opening to form a fluid-tight seal against a predetermined digestion pressure and temperature within the chamber;

a container within the digestion chamber for holding a cellulosic material;

a fluid-transporting system adapted to direct digestion fluid from a supply in the digestion chamber through a port toward any cellulosic material in the container; and a single egress for draining digestion fluid from the digestion chamber via gravitational flow.

* * * * *